US011011327B2

(12) United States Patent
Yang et al.

(10) Patent No.: US 11,011,327 B2
(45) Date of Patent: May 18, 2021

(54) ROTARY BRIDGE MICRO-SWITCH

(71) Applicants: Defond Electech Co., Ltd., Dongguan (CN); Defond Components Limited, Chaiwan (HK)

(72) Inventors: Bang Yan Yang, Dongguan (CN); Dong Wang, Dongguan (CN); Xian Feng Wang, Dongguan (CN); Xiao Yu Lai, Dongguan (CN); Hua Lin Pan, Dongguan (CN)

(73) Assignees: DEFOND ELECTECH CO., LTD., Donguan (CN); DEFOND COMPONENTS LIMITED, Hongkong (CN)

( * ) Notice: Subject to any disclaimer, the term of this patent is extended or adjusted under 35 U.S.C. 154(b) by 0 days.

(21) Appl. No.: 16/820,021

(22) Filed: Mar. 16, 2020

(65) Prior Publication Data

US 2020/0312587 A1 Oct. 1, 2020

(30) Foreign Application Priority Data

Mar. 25, 2019 (CN) ..... 201920388149.X

(51) Int. Cl.

| | |
|---|---|
| ***H01H 13/36*** | (2006.01) |
| ***H01H 13/14*** | (2006.01) |
| ***H01H 13/52*** | (2006.01) |

(52) U.S. Cl.

CPC ..... *H01H 13/14* (2013.01); *H01H 13/52* (2013.01); *H01H 2205/004* (2013.01); *H01H 2225/014* (2013.01)

(58) Field of Classification Search

CPC ..... H01H 13/36; H01H 13/52; H01H 13/186; H01H 13/28; H01H 13/30; H01H 13/42; H01H 13/14; H01H 2003/466; H01H 13/12; H01H 13/183; H01H 13/20; H01H 5/18; H01H 13/10; H01H 13/40; H01H 2225/014; H01H 2205/004

See application file for complete search history.

(56) References Cited

U.S. PATENT DOCUMENTS 4,011,419 A * 3/1977 Anderson ..... H01H 13/28 200/462

* cited by examiner

*Primary Examiner* — Ahmed M Saeed

(57) ABSTRACT

Disclosed is a rotary bridge micro-switch. The rotary bridge micro-switch comprises an insulating base, wherein a first terminal, a second terminal and a third terminal are arranged on the insulating base and are spaced from one another by the insulating base; and the insulating base is rotatably connected to a conducting plate having one end abutting against the first terminal. The rotary bridge micro-switch further comprises a spring having two ends respectively connected to the other end of the conducting plate and the insulating base. When the spring is not compressed, the first terminal is connected to the second terminal through the other end of the conducting plate. When the spring is compressed, the first terminal is connected to the third terminal. The rotary bridge micro-switch can be pressed to realize switching between two circuits.

7 Claims, 4 Drawing Sheets

ROTARY BRIDGE MICRO-SWITCH

FIELD OF INVENTION

The present invention relates to the technical field of electrical switches, in particular to a rotary bridge micro-switch.

BACKGROUND OF INVENTION

Description of Related Art

The switch is an electronic element used to turn off a circuit to cut off currents or to enable the currents to flow to other circuits. The most common switches are electromechanical devices to be operated by users and have one or more electronic contacts, wherein the electronic contacts can be "closed" (which indicates that the electronic contacts are turned on) to allow currents to flow through and can be "opened" (which indicates that the electronic contacts are turned off) to not allow the currents to flow through.

An elastic switch which can turn on one circuit under normal conditions and can turn on another circuit when pressed is not yet available on the present market.

SUMMARY OF THE INVENTION

To overcome the drawbacks and defects of the prior art, the objective of the utility model is to provide a rotary bridge micro-switch which can be pressed to realize switching between two circuits.

The utility model is implemented through the following technical solution:

A rotary bridge micro-switch comprises an insulating base, wherein a first terminal, a second terminal and a third terminal are arranged on the insulating base from one end the other end and are spaced from one another by the insulating base. The insulating base is rotatably connected to a conducting plate having one end abutting against the first terminal. The rotary bridge micro-switch further comprises a spring having two ends respectively connected to the other end of the conducting plate and the insulating base. When the spring is not compressed, the first terminal is connected to the second terminal through the other end of the conducting plate. When the spring is compressed, the first terminal is connected to the third terminal.

Wherein, the conducting plate comprises a conducting strip, first connecting strips and second connecting strips, wherein the conducting strip is rotatably connected to the insulating base; the first connecting strips are arranged at one end of the conducting strip, abut against the first terminal and are electrically connected to the first terminal; and the second connecting strips enable the first terminal to be connected to the second terminal or enable the first terminal to be connected to the third terminal.

Wherein, the number of the first connecting strips is two, and the two first connecting strips are symmetrically arranged with respect to the conducting strip and are respectively disposed on two sides of the first terminal.

Wherein, first contacts are arranged on inner sides of the two first connecting strips.

Wherein, the number of the second connecting strips is two, and the two second connecting strips are symmetrically arranged with respect to the conducting strip.

Wherein, second contacts are arranged on inner sides of the two second connecting strips.

Wherein, the rotary bridge micro-switch further comprises a press part, and the bottom end of the press part is connected to the other end of the conducting plate.

Wherein, the rotary bridge micro-connector further comprises a shell, wherein one end of the first terminal, one end of the second terminal, one end of the third terminal, the insulating base and the conducting plate are all located in the shell, and the other end of the first terminal, the other end of the second terminal and the other end of the third terminal penetrate through the shell; and one end of the second terminal is isolated from one end of the third terminal by the base.

The utility model has the following beneficial effects:

Circuit switching is realized by pressing: the rotary bridge micro-switch of the utility model can turn on one circuit under normal conditions; and the conducting plate can be pressed to rotate to turn off the previous circuit and to turn on another circuit. In the pressing process, the spring is pressed by the conducting plate to be in a compressed state; and after the conducting plate is released, the spring restores under the effect of elastic potential energy and pushes the conducting plate to the original position, so that the previous circuit is turned on by the micro-switch of the utility model.

REFERENCE SIGNS

11, insulating base; 12, shell; 13, press part; 21, first terminal; 22, second terminal; 23, third terminal; 3, conducting plate; 31, conducting strip; 32, first connecting strip; 33, second connecting strip; 34, first contact; 35, second contact; 4, spring.

DESCRIPTION OF THE PREFERRED EMBODIMENTS

The implementations of the utility model are explained below with specific embodiments. Those skilled in the art can easily appreciate other advantages and effects of the utility model with reference to the contents disclosed in this specification. The utility model can also be implemented or applied through other different specific embodiments. On the basis of different points of view and applications, all details in this specification can be modified or transformed in various ways without deviating from the spirit of the utility model.

It should be noted that all structures illustrated by the accompanying drawings are only used for assisting those skilled in the art in understanding and reading in cooperation with the contents disclosed in the specification, and are not intended to limit the implementation conditions of the utility model, thus not having substantive meanings technically. Any structural modifications or transformations obtained without affecting the effects and purposes of the utility model should also fall within the scope defined by the technical contents of the utility model.

Figure 1:
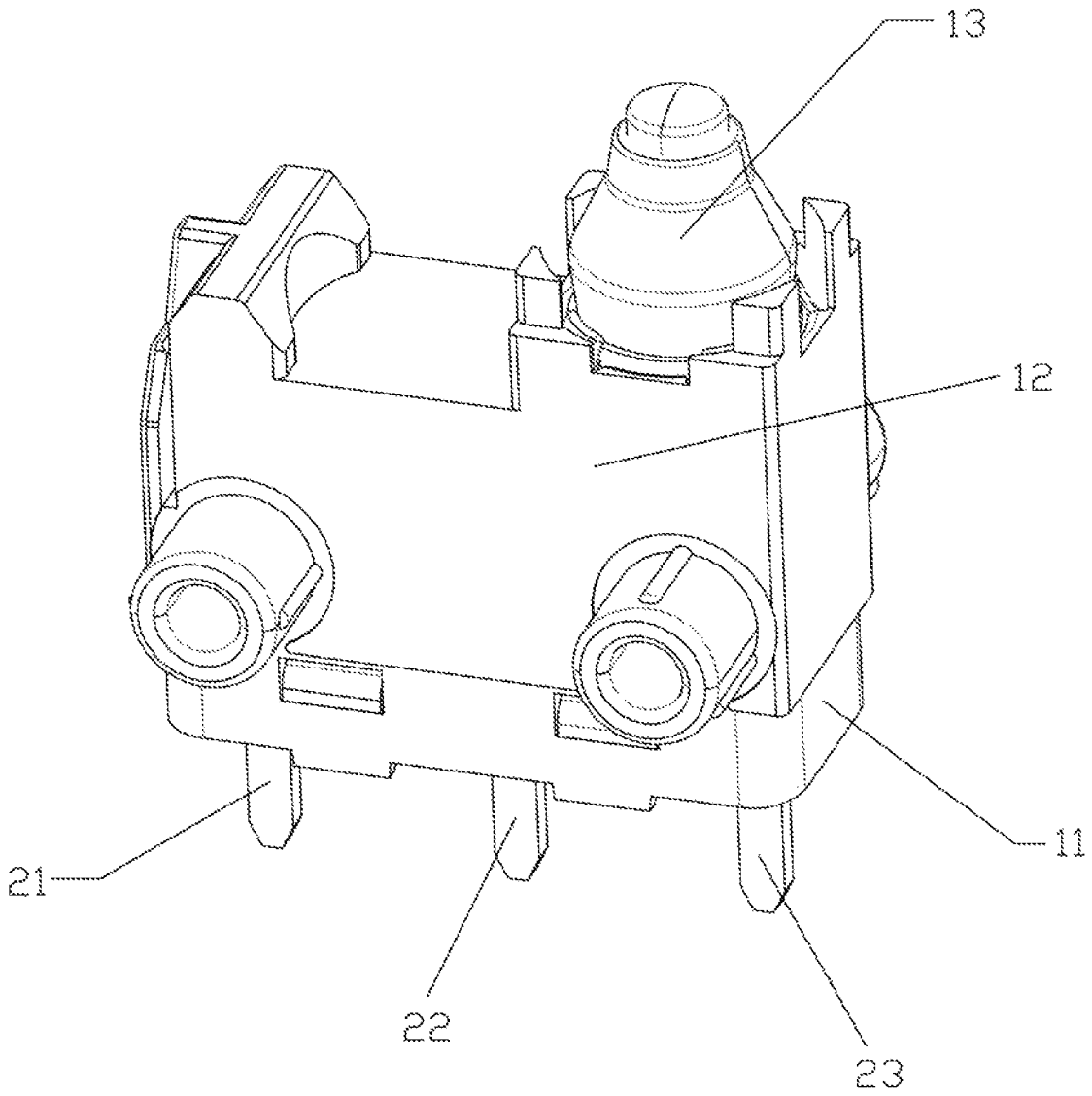
FIG. 1 is a perspective structural view of the utility model.
Figure 2:
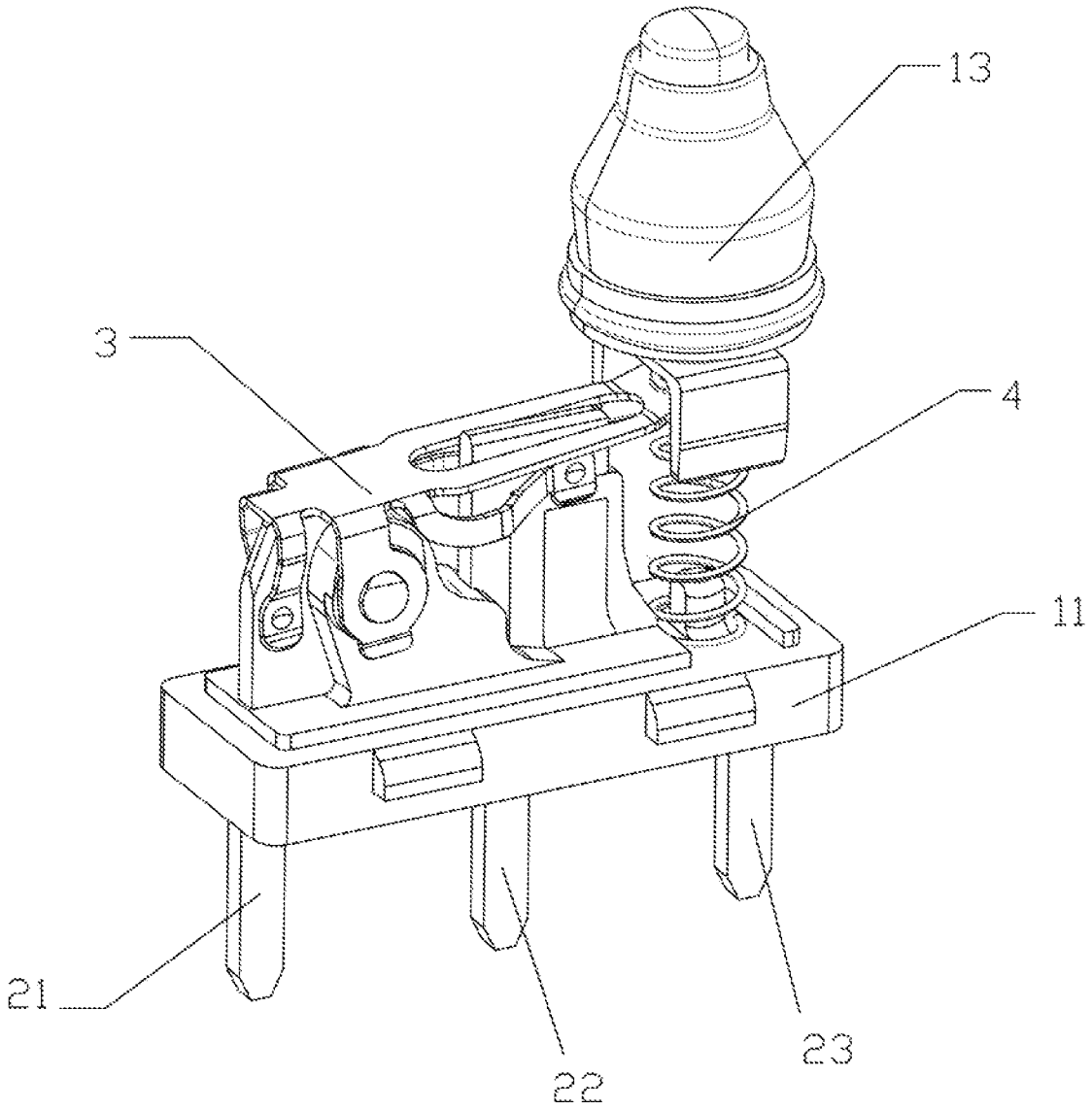
FIG. 2 is an internal structural view of the utility model.
Figure 3:
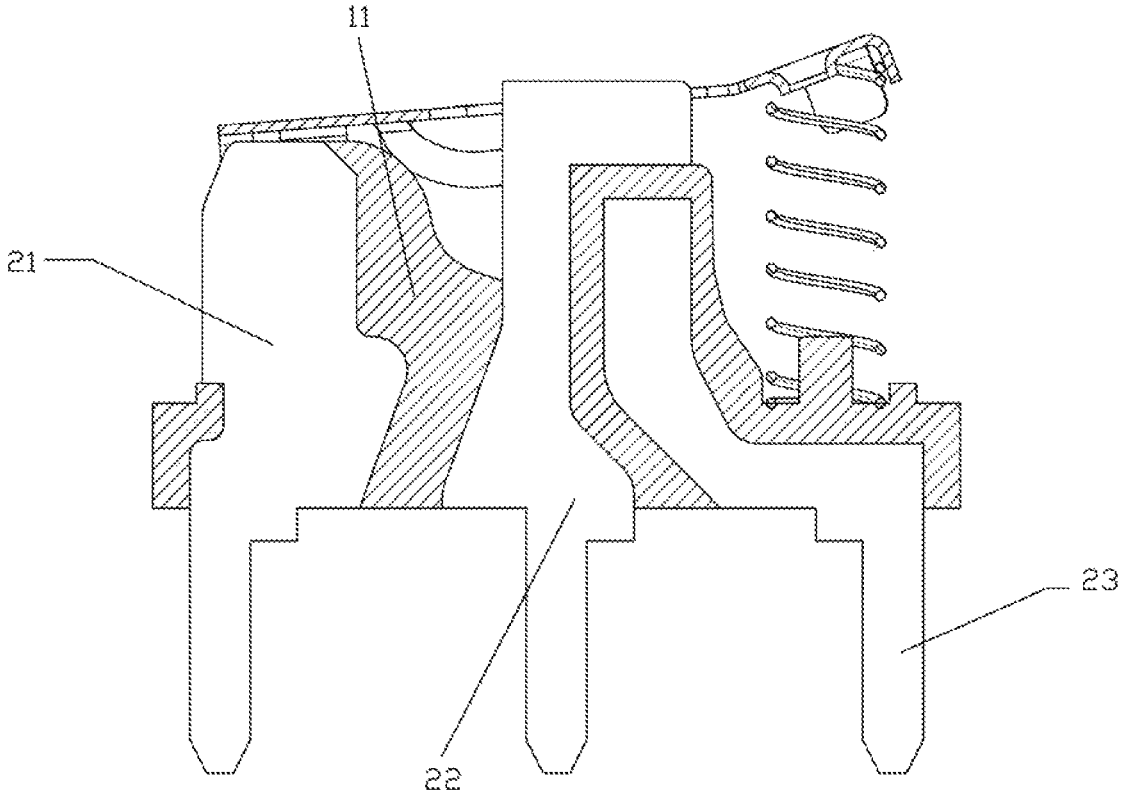
FIG. 3 is a sectional view of the utility model.
Figure 4:
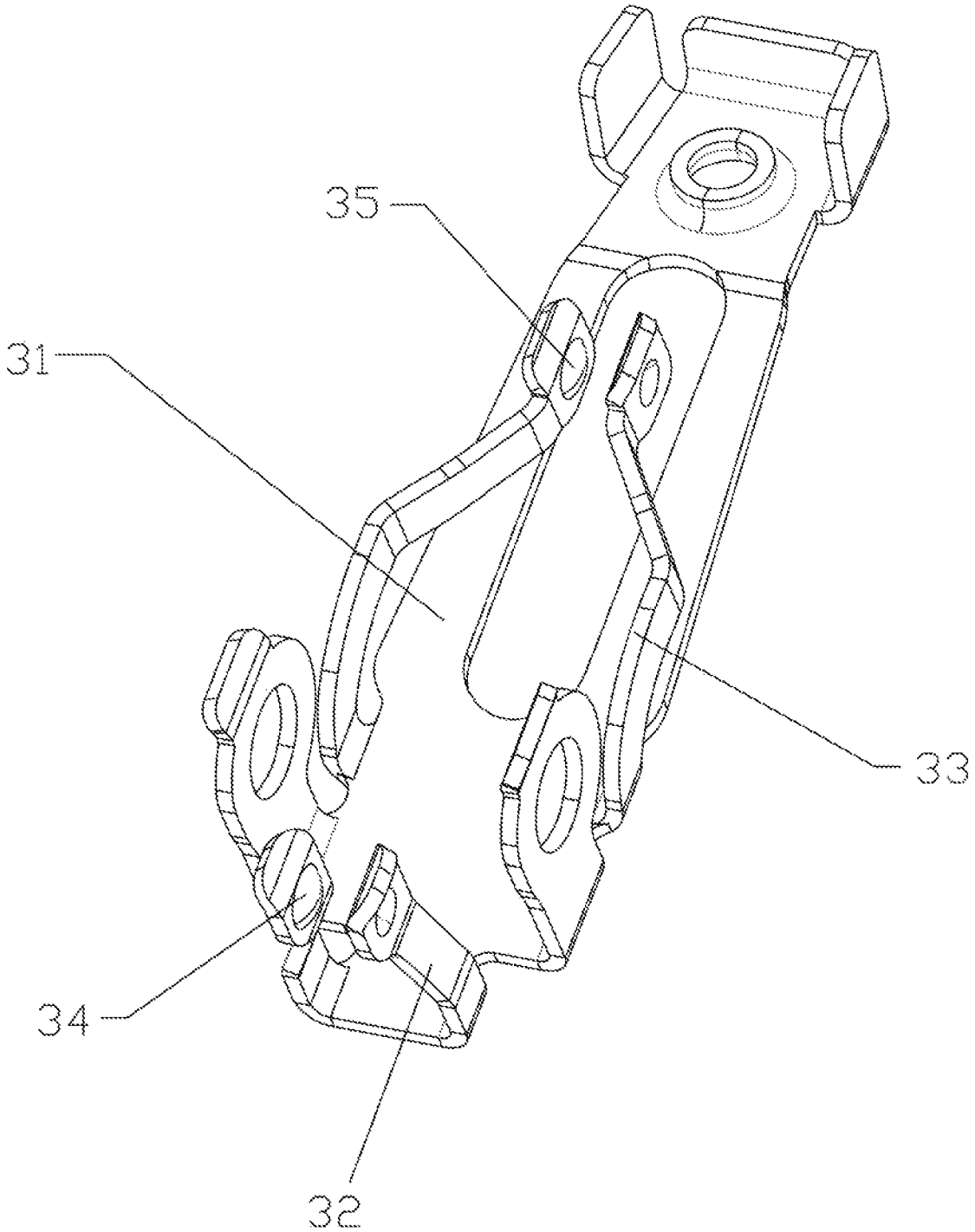
FIG. 4 is a structural view of a conducting plate of the utility model.

As shown in FIG. 1-FIG. 3, a rotary bridge micro-switch comprises an insulating base 11, wherein a first terminal 21, a second terminal 22 and a third terminal 23 are arranged on the insulating base 11 from one end to the other end and are spaced from one another by the insulating base 11; and the insulating base 11 is rotatably connected to a conducting plate 3 having one end abutting against the first terminal 21. The rotary bridge micro-switch further comprises a spring 4 having two ends respectively connected to the other end of the conducting plate 3 and the insulating base 11. When the spring 4 is not compressed, the first terminal 21 is connected to the second terminal 22 through the other end of the conducting plate 3. When the spring 4 is compressed, the first terminal 21 is connected to the third terminal 23.

The rotary bridge micro-switch in this embodiment has the following effects:

Circuit switching is realized by pressing: the rotary bridge micro-switch in this embodiment can turn on a circuit (which is formed by the first terminal 21, the second terminal 22 and an external device) under normal conditions; and the conducting plate 3 can be pressed to rotate to turn off the previous circuit and to turn on another circuit (formed by the first terminal 21, the third terminal 23 and the external device). In the pressing process, the spring 4 is pressed by the conducting plate 3 to be in a compressed state; and when the conducting plate 3 is released, the spring 4 restores under the effect of elastic potential energy to push the conducting plate 3 to the original position, so that the previous circuit is turned on by the micro-switch in this embodiment.

Specifically, the conducting plate 3 comprises a conducting strip 31, first connecting strips 32 and second connecting strips 33, wherein the conducting strip 31 is rotatably connected to the insulating base 11; the first connecting strips 32 are arranged at one end of the conducting strip 31, abut against the first terminal 21 and are electrically connected to the first terminal 21; and the second connecting strips 33 enable the first terminal 21 to be connected to the second terminal 22 or enable the first terminal 21 to be connected to the third terminal 23. The number of the first connecting strips 32 is two, and the two first connecting strips 32 are symmetrically arranged with respect to the conducting strip 31 and are respectively disposed on two sides of the first terminal 21; first contacts 34 are arranged on inner sides of the two first connecting strips 32; and the number of the second connecting strips 33 is two, the two connecting strips 33 are symmetrically arranged with respect to the conducting strip 31, and second contacts 35 are arranged on inner sides of the two second connecting strips 33.

In actual use, the first contacts 34 always make contact with the first terminal 21, the second contacts 35 make contact with the second terminal 22 when the spring 4 is not subjected to deformation caused by an external force. In this case, the first terminal 21 is connected to the second terminal 22 through the conducting plate 3, and the third terminal 23 is disconnected with other terminals under the effect of the insulating base 11; and at this moment, the other end of the conducting plate 3 is pressed, so that the conducting plate 3 rotates to enable the second contacts 35 to be separated from the second terminal 22 and to make contact with the third terminal 23, and thus, circuit switching is completed.

The rotary bridge micro-switch further comprises a shell 12, wherein one end of the first terminal 21, one end of the second terminal 22, one end of the third terminal 23, the insulating base 11 and the conducting plate 3 are all located in the shell 12, the other end of the first terminal 21, the other end of the second terminal 22 and the other end of the third terminal 23 penetrate through the shell 12, and the internal structure of the micro-switch can be protected by the shell 12; and one end of the second terminal 22 is isolated from one end of the third terminal 23 by the base 11 which is made from an insulating material, and the base 11 can isolate the circuit formed by the second terminal 22 and the external device from the circuit formed by the third terminal 23 and the external device.

In this embodiment, the rotary bridge micro-switch further comprises a press part 13, and the bottom end of the press part 13 is connected to the other end of the conducting plate 3. Users can press the conducting plate 3 in the shell 12 through the press part 13.

Finally, it should be noted that the above embodiments are only used to explain the technical solution of the utility model, and are not intended to limit the protection scope of the utility model. Although the utility model has been expounded with reference to preferred embodiments, those ordinarily skilled in the art would appreciate that the technical solution of the utility model can be modified or equivalently substituted without deviating from its essence and scope.

What is claimed is:

1. A rotary bridge micro-switch, comprising an insulating base, wherein a first terminal, a second terminal and a third terminal are arranged on the insulating base from an end to another end and are spaced from one another by the insulating base;

a conducting plate having an end abutting against the first terminal is rotatably connected to the insulating base, the conducting plate comprises a conducting strip rotatably connected to the insulating base, first connecting strips and second connecting strips;

the first connecting strips are arranged at one end of the conducting strip, abut against the first terminal and are electrically connected to the first terminal;

the second connecting strips enable the first terminal to be connected to the second terminal or enable the first terminal to be connected to the third terminal;

the rotary bridge micro-switch further comprises a spring having two ends respectively connected to an end of the conducting plate and the insulating base;

when the spring is not compressed, the first terminal is connected to the second terminal through the corresponding end of the conducting plate; and when the spring is compressed, the first terminal is connected to the third terminal.

2. The rotary bridge micro-switch according to claim 1, wherein a number of the first connecting strips is two, and the two first connecting strips are symmetrically arranged with respect to the conducting strip and are respectively arranged on two sides of the first terminal.

3. The rotary bridge micro-switch according to claim 2, wherein first contacts are arranged on inner sides of the two first connecting strips.

4. The rotary bridge micro-switch according to claim 1, wherein a number of the second connecting strips is two, and the two second connecting strips are symmetrically arranged with respect to the conducting strip.

5. The rotary bridge micro-switch according to claim 4, wherein second contacts are arranged on inner sides of the two second connecting strips.

6. The rotary bridge micro-switch according to claim 1, wherein the rotary bridge micro-switch further comprises a press part having a bottom end connected to the corresponding end of the conducting plate.

7. The rotary bridge micro-switch according to claim 1, wherein the rotary bridge micro-switch further comprises a shell; an end of the first terminal, an end of the second terminal, an end of the third terminal, the insulating base and the conducting plate are located in the shell; an end of the first terminal, an end of the second terminal and an end of the third terminal penetrate through the shell; and one end of the second terminal is isolated from one end of the third terminal by the base.

* * * * *